US006176194B1

(12) United States Patent
Seyfang et al.

(10) Patent No.: US 6,176,194 B1
(45) Date of Patent: Jan. 23, 2001

(54) LIFT ARRANGEMENTS

(75) Inventors: George R Seyfang; Christopher J Hunter, both of Preston (GB)

(73) Assignee: Bae Systems plc, Farnborough (GB)

( * ) Notice: Under 35 U.S.C. 154(b), the term of this patent shall be extended for 0 days.

(21) Appl. No.: 09/397,868

(22) Filed: Sep. 17, 1999

Related U.S. Application Data

(63) Continuation of application No. PCT/GB99/00964, filed on Mar. 26, 1999.

(30) Foreign Application Priority Data

Mar. 28, 1998 (GB) ..... 9806591

(51) Int. Cl.[7] ..... B63B 35/44
(52) U.S. Cl. ..... 114/261; 187/249
(58) Field of Search ..... 187/249, 252; 114/258, 261, 72; 414/261, 262, 592

(56) References Cited

U.S. PATENT DOCUMENTS 2,383,559 * 8/1945 Parker ..... 114/261
4,084,660 * 4/1978 Anderson ..... 187/249
4,195,962 4/1980 Laskowski et al. .
5,197,570 * 3/1993 Matsui ..... 187/249
5,758,748 * 6/1998 Barker et al. ..... 187/249

FOREIGN PATENT DOCUMENTS 2 375 411 11/1977 (FR) .
2 170 475 8/1986 (GB) .
2 271 757 4/1994 (GB) .

* cited by examiner

*Primary Examiner*—Stephen Avila
(74) *Attorney, Agent, or Firm*—Nixon & Vanderhye P.C.

(57) ABSTRACT

A lift arrangement for conveying a load between two levels in a lift shaft, said lift arrangement comprising two platform means each mounted for movement within said lift shaft between one level and the other, each platform means being changeable between a load-carrying configuration in which it extends across a substantial extent of the lift shaft, and a bypass configuration in which it allows the other floor means to pass it when in a load carrying configuration.

12 Claims, 2 Drawing Sheets

BASIC BASCULE AT FLIGHT DECK

AT HANGER FLOOR

REDUCED TIME/EXPOSURE
AT FLIGHT DECK

AT HANGER FLOOR

LIFT ARRANGEMENTS

This is a continuation of PCT application No. PCT/GB99/00964, filed Mar. 26, 1999, the entire content of which is hereby incorporated by reference in this application.

BACKGROUND OF THE INVENTION

1. Field of the Invention

This invention relates to lift arrangements and in particular, but not exclusively, to lift arrangement for conveying an aircraft from one deck to the other in an aircraft carrier.

2. Discussion of Prior Art

In most aircraft carriers, the aircraft are stored in a hangar deck and need to be conveyed to the flight deck by one or more lifts. Most aircraft carriers have at least 2 lifts, and some large American carriers have 3 or 4 lifts. Only that minimum number of lifts necessary to enable the carrier to function efficiently is included in each design of carrier because extra lifts entail extra cost and lost below-deck hangar space. In a conventional lift cycle an aircraft is towed into the correct position on the lift, lashed down and the towing device removed. The lift then transits to the flight deck whereupon a towing device is attached, the aircraft is unlashed and towed clear of the lift. The lift then transits back to the hangar deck and the process is repeated. The time taken to transfer aircraft between the flight deck and hangar is one of the critical factors which affects the potential flying rate from the aircraft carrier. In an emergency, minutes lost transferring aircraft from the hangar deck to the flight deck could significantly reduce the number of aircraft deployed within a short period, and have disastrous consequences.

Accordingly there is a need for a lift arrangement which increases the rate at which aircraft can be moved between the hangar deck and the flight deck via a single lift shaft.

SUMMARY OF THE INVENTION

In one aspect, this invention provides a lift arrangement for conveying a load between two levels in a lift shaft, said lift arrangement comprising two platform means each mounted for movement within said lift shaft between one level and the other, each platform means being changeable between a load-carrying configuration in which it extends across a substantial extent of the lift shaft, and a bypass configuration in which it allows the other floor means to pass it when in a load carrying configuration.

In this arrangement, because the two platform means can pass each other in the lift shaft (one in load-carrying configuration, the other in bypass configuration), it is possible for the load on one level to be unloaded or manoeuvred as necessary off one of the platform means, whilst a different load is being loaded or manoeuvred on to the other platform means, thus considerably reducing the total cycle time to approximately half of that with a conventional system. The term "lift shaft" is used broadly to mean any space through which the load carrying platform may move and does not denote any particular form of structure.

Preferably, each platform means comprises two floor elements moveable between a generally co-planar load-carrying configuration and a bypass configuration in which they lie adjacent the periphery of the lift shaft.

Preferably, said floor elements are pivotally mounted on a support structure movable mounted within said lift shaft. The floor elements are preferably pivotally mounted for movement about generally horizontal pivotal axes adjacent the edge of the shaft.

Preferably, the arrangement includes control means for controlling and sequencing the configuration and movement of said platform means.

Preferably, the control means is operable to effect reciprocal movement of said platform means whereby one platform means moves from one level to the other in a load-carrying configuration as the other platform means moves from the other level to said one level when in said bypass configuration. The control means is preferably also operable to cause the respective floor means to move from said load carrying configuration to said bypass configuration as required to allow the platform means to pass each other in the lift shaft.

In a particular preferred arrangement, the control arrangement is operable in use to cause the platform means currently in the bypass configuration to begin to move to said load-carrying configuration once the platform means have passed each other in the lift shaft. This not only has advantages in terms of reducing the cycle time, but it also means that the period for which the lift shaft is open or exposed may be reduced and this may be particularly beneficial where the lift arrangement is used for conveying aircraft between the hangar deck and the flight deck of an aircraft carrier.

The invention also extends to an aircraft carrier incorporating a lift arrangement as described above.

Whilst the invention is being described above, it extends to any inventive combination of features set out above or in the following description.

BRIEF DESCRIPTION OF THE DRAWINGS

The invention may be performed in various ways, and an embodiment thereof will now be described by way of example only, reference being made to the accompanying drawings in which.

DETAILED DISCUSSION OF PREFERRED EMBODIMENTS

Figure 1A:
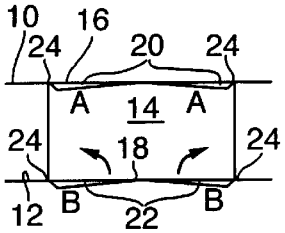
FIGS. 1(*a*), (*b*), (*c*), (*d*), and (*e*) are schematic transverse views through the flight deck and hangar deck of an aircraft carrier incorporating a lift arrangement in accordance with this invention, showing the sequence of operations as aircraft are moved from the flight deck down to the hangar deck.
Figure 2A:
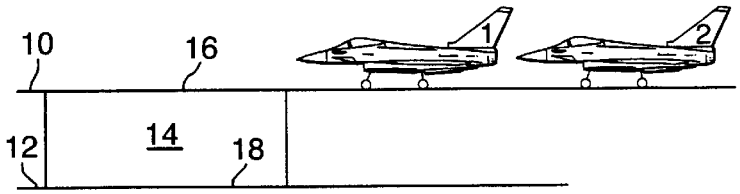
FIGS. 2(*a*) to (*e*) are side views of the arrangement of FIG. 1 showing the same steps.
Figure 1B:
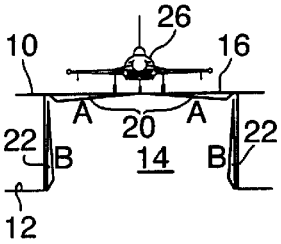
Figure 2B:
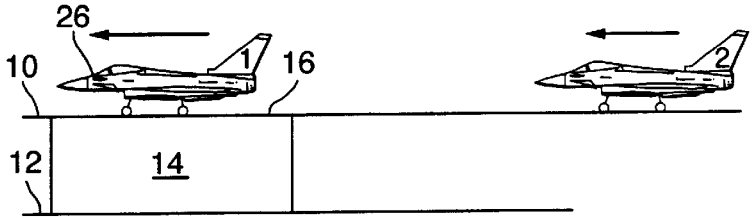
Figure 1C:
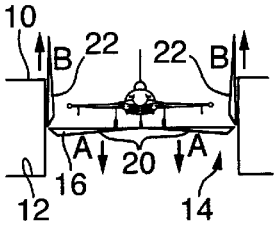
Figure 2C:
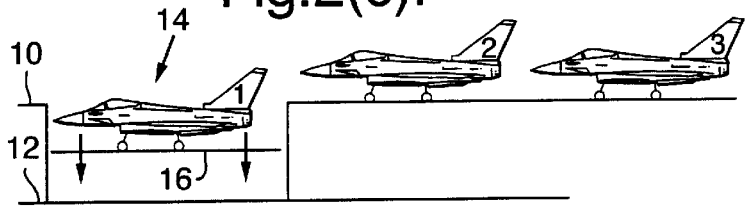
Figure 1D:
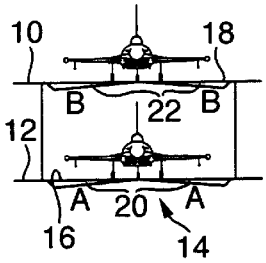
Figure 2D:
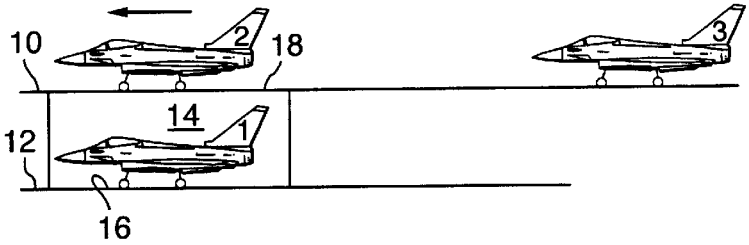
Figure 1E:
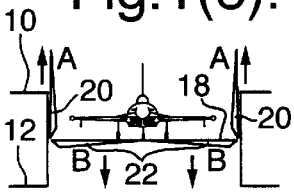
Figure 2E:
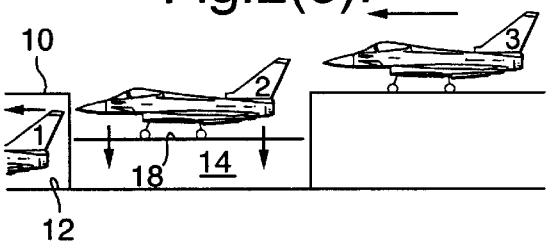
Figure 3A:
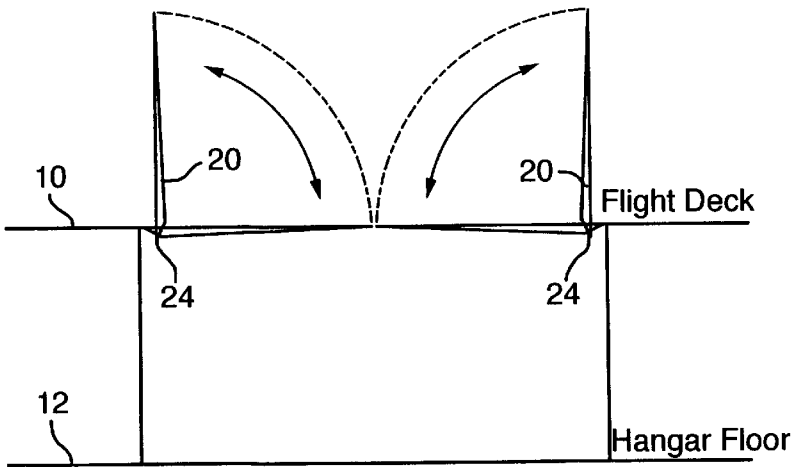
FIGS. 3(*a*) and (*b*) illustrate the opening and closing movement of the lift half floors in a first embodiment of this invention, and FIGS. 4(*a*) and (*b*) illustrate the opening and closing movement of the lift half floors in a second embodiment of this invention.
Figure 3B:
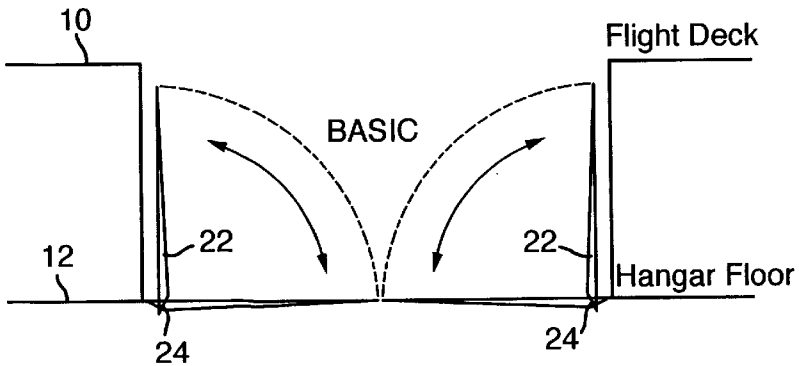
Figure 4A:
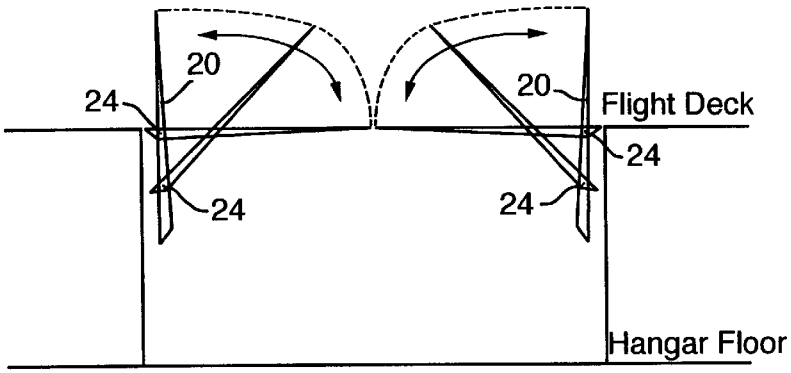
Figure 4B:
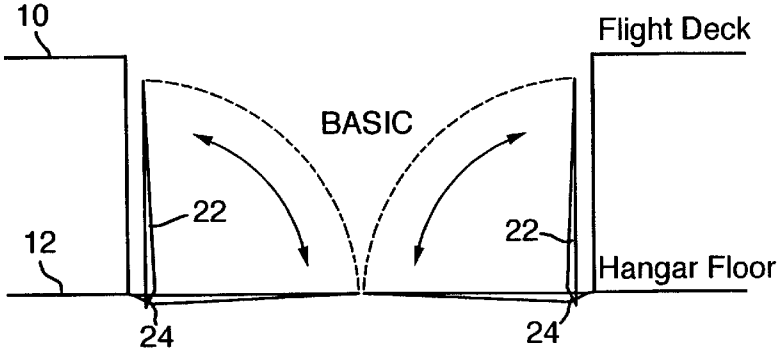

Referring initially to FIGS. 1 to 3, the flight deck 10 and hangar deck 12 of an aircraft carrier are illustrated, connected by a rectangular lift shaft 14 of cross-section slightly larger than that of a conventional shaft. Within the lift shaft are disposed two lift platforms 16 and 18 respectively. Each lift platform is made up of two half lift floors 20, 24 respectively each pivotally mounted on a support structure (not shown) for movement about respective axes 22 between the load carrying configuration shown in FIGS. 1(*a*) and 1(*d*) and the bypass configuration see for example FIG. 1(*b*). In addition, each lift platform 20,22 can move from the flight deck 10 to the hangar deck 12 and vice versa. The lift arrangement also includes a controller (not shown) which sequences both the vertical movement of the lift platforms and their movement between the load-carrying configuration and the bypass configuration. Thus, as seen in FIGS. 1(*a*) to 1(*e*) a sequence for transferring a number of aircraft 26 from the flight deck 10 back down to the hangar deck 12 might be as follows, reference being made to the "first" and "second" platforms 16, 18, for clarity. With both platforms 16 and 18 initially in the load-carrying position, the second platform 18 is moved to the bypass configuration and the first aircraft is towed into position on the first platform 16 and lashed in place (FIG. 1(*b*)). The first platform 16 is lowered and the second platform rises and passes it in the bypass configuration (FIG. 1(*c*)). When the second platform reaches the flight deck 10, it is returned into the load-carrying configuration and the second aircraft is manoeuvred into position and lashed down, whilst the first aircraft is unlashed and towed off into the hangar deck. The process then repeats as necessary. Of course, aircraft may be moved in the other direction by reversing this sequence.

As noted above, this arrangement effectively doubles the aircraft handling rate because there are two platforms each moving in anti-phase and as one aircraft is being towed into position and lashed down, so at the other level the other aircraft is being unlashed and towed away.

Referring now to FIG. 3, this shows the opening sequence for the two half floors 20, 22 in the first embodiment. In the first embodiment, the half floors 20, 22 are only pivoted between the bypass configuration and load configuration when the pivot axes 24 are at either the hangar deck or the flight deck.

In the second embodiment, when moving aircraft down from the flight deck 10 the half floors 20,22 of the upwardly moving platform start to pivot from the by-pass configuration to the load-carrying configuration as soon as it has passed the downwardly moving platform. When operating in the other sense, to raise aircraft to the flight deck, the downwardly moving platform may start to pivot from load-carrying configuration to by-pass configuration as it starts moving downwardly.

What is claimed is:

1. A lift arrangement for conveying a load between two levels in a lift shaft, said lift arrangement comprising: two platform means each mounted for movement within said lift shaft between one level and the other, each platform means being changeable between a load-carrying configuration in which it extends across a substantial extent of the lift shaft, and a bypass configuration in which it allows the other platform means to pass it when in a load carrying configuration, wherein each platform means comprises two floor elements moveable between a generally co-planar load-carrying configuration and a bypass configuration in which they lie adjacent the periphery of the lift shaft, wherein said floor elements of each platform means are pivotally mounted for separate movement about generally horizontal pivotal axes adjacent the edge of the shaft.

2. A lift arrangement for conveying a load between two levels in a lift shaft, said lift arrangement comprising: two platform means each mounted for movement within said lift shaft between one level and the other, each platform means being changeable between a load-carrying configuration in which it extends across a substantial extent of the lift shaft, and a bypass configuration in which it allows the other platform means to pass it when in a load carrying configuration, wherein each platform means comprises two planar floor elements moveable between a generally co-planar load-carrying configuration and a bypass configuration in which they lie adjacent the periphery of the lift shaft.

3. A lift arrangement according to claim 2, wherein said floor elements are pivotally mounted on a support structure movable mounted within said lift shaft.

4. A lift arrangement according to claim 2, wherein said floor elements are pivotally mounted for movement about generally horizontal pivotal axes adjacent the edge of the shaft.

5. A lift arrangement according to claim 2, including control means for controlling and sequencing the configuration and movement of said platform means.

6. A lift arrangement according to claim 5, wherein said control means is operable to effect reciprocal movement of said platform means whereby one platform means moves from one level to the other in a load-carrying configuration as the other platform means moves from the other level to said one level when in said bypass configuration.

7. A lift arrangement according to claim 6 wherein said control means is also operable to cause the respective floor means to move from said load carrying configuration to said bypass configuration as required to allow the platform means to pass each other in the lift shaft.

8. An aircraft carrier incorporating a lift arrangement according to claim 2.

9. A lift arrangement according to claim 5, wherein said control means is operable to cause the platform means currently in the bypass configuration to begin to move to the load-carrying configuration once the platform means have passed each other in the lift shaft.

10. A lift arrangement for conveying a load between two levels in a lift shaft, said lift arrangement comprising two platform means each mounted for movement within said lift shaft between one level and the other, each platform means being changeable between a load-carrying configuration in which it extends across a substantial extent of the lift shaft and a bypass configuration in which it allows the other platform means to pass it when in a load-carrying configuration, the lift arrangement further comprising control means for controlling and sequencing the configuration and movement of said platform means, the control means being operable in use to cause the platform means currently in the bypass configuration to begin to move to the load-carrying configuration once the platform means have passed each other in the lift shaft.

11. A lift arrangement for conveying a load between two levels in a lift shaft, said lift arrangement comprising: two platforms, each platform mounted for movement within said lift shaft between one level and the other, each platform being changeable between a load-carrying configuration in which it extends across a substantial extent of the lift shaft, and a bypass configuration in which it allows the other platform to pass when in a load carrying configuration, wherein each platform comprises two planar floor elements moveable between a generally co-planar load-carrying configuration and a bypass configuration in which they lie adjacent the periphery of the lift shaft.

12. An aircraft elevator for conveying aircraft between two levels in an aircraft carrier, said elevator located in a lift shaft and comprising:

two moveable platforms, each platform mounted for movement within said lift shaft between said two levels, each platform being changeable between an aircraft carrying configuration in which the platform extends across a substantial extent of the lift shaft in a generally horizontal orientation, and a bypass configuration in which the platform is in a generally vertical orientation and allows the other platform to pass when said other platform is in said aircraft carrying configuration.

* * * * *